United States Patent [19]

Gerardy

[11] 3,933,160

[45] Jan. 20, 1976

[54] TOBACCO-SMOKE FILTERS

[75] Inventor: Guy V. A. Gerardy, Waterloo, Belgium

[73] Assignee: British-American Tobacco Company Limited, London, England

[22] Filed: Aug. 22, 1973

[21] Appl. No.: 390,504

[30] Foreign Application Priority Data

Sept. 1, 1972 Belgium ..... 12161

[52] U.S. Cl. ..... 131/264; 93/1 C; 93/77 FT

[51] Int. Cl. ..... A24c 5/50

[58] Field of Search ..... 131/264, 261 B, 261 R, 131/10.5, 10.9, 10.7, 10 R

[56] References Cited

UNITED STATES PATENTS

| | | | |
|---|---|---|---|
| 2,064,239 | 12/1936 | Aviaz | 131/264 |
| 2,159,121 | 5/1939 | Alley | 131/264 |
| 2,916,039 | 12/1959 | Muller | 131/264 |

OTHER PUBLICATIONS

Hawkins, Def. Pub. Search Copy of Serial No. 775,576, CL 131-10.7X, Filed 9-12-1965, Published in 860 06 1007, Def. Pub. No. T860,013.

*Primary Examiner*—Joseph S. Reich
*Attorney, Agent, or Firm*—Kane, Dalsimer, Kane, Sullivan & Kurucz

[57] ABSTRACT

This invention concerns improvements relating to tobacco-smoke filters, particularly cigarette filters, and to a method and apparatus for their production. According to the invention in a tobacco-smoke filter composed of absorbent paper and a filtering composition comprising a tow of fibrous or filamentary material, such as cellulose acetate, fibrillated or filamentary polypropylene, viscose or the like, associated with the paper in superimposed layers which are rolled or folded substantially parallel to the longitudinal axis of the filter, the absorbent paper and filtering composition are in the form of strips extending longitudinally of the filter, the filtering-composition strip having a greater width than the paper strip and being so associated with the paper strip that it covers one face of the latter and is folded over along the two longitudinal edges of the paper strip to cover at least part and preferably the whole of the other face thereof.

3 Claims, 6 Drawing Figures

TOBACCO-SMOKE FILTERS

Figure 1:
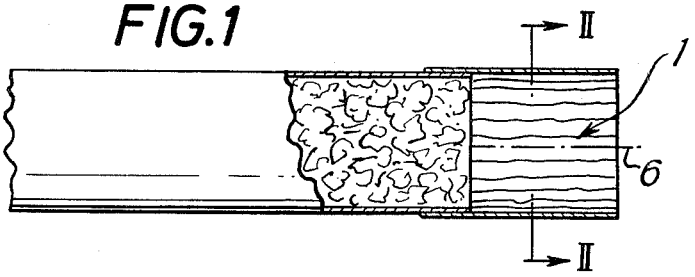

This invention concerns improvements relating to tobacco-smoke filters, particularly cigarette filters, composed of absorbent paper and a filtering composition associated with the paper in superimposed layers wound or folded substantially parallel to the longitudinal filter axis.

The invention seeks to provide a filter whose retention, permeability and crush-resistance properties are at least equivalent to those of existing filters, and which can either be made more economically than most filters currently in use and composed of an absorbent paper element and a cellulose acetate element joined end to end, or which is less expensive, because of the use of basic materials, namely paper and, for example, cellulose acetate, whose cost is less than other materials used in filters, for example paper having fine regular grooves, shredded or perforated corrugated paper and paper to which is secured a filtering layer in the form of a fiber flock or pad.

According to the invention, in a tobacco-smoke filter composed of absorbent paper and a filtering composition comprising a tow of fibrous or filamentary material, such as cellulose acetate, fibrillated or filamentary polypropylene, viscose or the like, associated with the paper in superimposed layers which are rolled or folded substantially parallel to the longitudinal axis of the filter, the absorbent paper and filtering composition are in the form of strips extending longitudinally of the filter, the filtering-composition strip having a greater width than the paper strip and being so associated with the paper strip that it covers one face of the latter and is folded over along the two longitudinal edges of the paper strip to cover at least part of the other face thereof.

Advantageously, the width of the filtering-composition strip is substantially equal to twice the width of the paper strip, so that the latter is completely enrobed or covered by the filtering composition.

According to the invention, a process for the production of tobacco-smoke filters comprises connecting together in a flat state a strip of absorbent paper and a strip of a filtering composition comprising a tow of fibrous or filamentary material, such as cellulose acetate, fibrillated or filamentary polypropylene, viscose or the like, having a greater width than the paper strip, this connection being effected by substantially superimposing the longitudinal axes of the two strips, supporting the resuultant assembly in such a manner that only the paper strip, situated under the filtering-composition strip, rests on the supporting means, guiding the latter strip so that it is folded over along the two longitudinal edges of the paper strip and that its two marginal portions are applied against the free face of the paper strip beyond the support, joining to the paper strip by pressure the two said portions of the filtering-composition strip, and folding the resultant assembly to form substantially a cylinder from which filters can be produced by cutting the cylinder at right angles to its axis.

According to the invention, an apparatus for producing tobacco-smoke filters comprises two spools, with parallel axes, for supporting respectively a reel of absorbent-paper strip and a reel of filtering-composition strip, at least two pressure rollers, disposed with their axes parallel to the axes of the spools, for connecting the strips together in a flat state, two guides which are disposed downstream of the rollers and one on each side of the connected strips, the filtering-composition strip being above the paper strip, and which are so profiled as to bear against marginal portions of the filtering-composition strip and to fold them downwardly along the longitudinal edges of the paper strip to an angle of about 90° with the latter, a support which is disposed downstream of the said guides under the assembly of the two strips and is of a width such that it supports the assembly over the width of the paper strip only, two further guides which are disposed downstream of the support and one on each side of the strips and are so profiled as to fold in the marginal portions of the filtering-composition strip and apply them against the free face of the paper strip, at least two pressure rollers arranged downstream of the last-mentioned guides for causing the filtering composition to adhere completely to the paper, means provided downstream of the last-mentioned rollers for folding the assembly of strips to substantially the form of a cylinder, and means for cutting the latter, at right angles to its axis, to produce filters.

A filter in accordance with the invention and a method and apparatus for its production will now be more fully described by way of example with reference to the accompanying drawing, in which:

FIG. 1 is a side view, partly broken away, of a cigarette provided with the filter.

Figure 2:
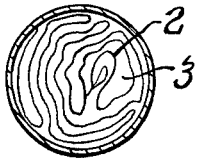
Figure 4:
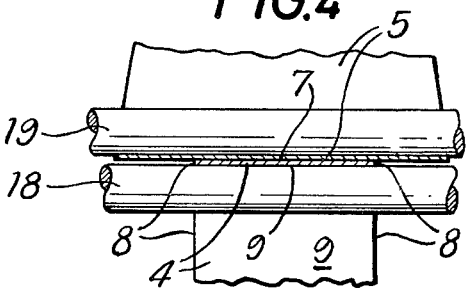
Figure 5:
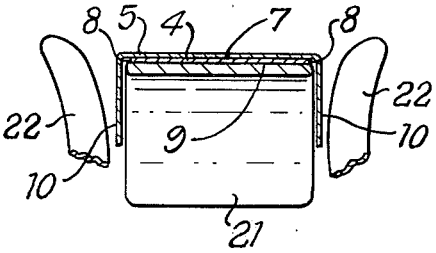
Figure 6:
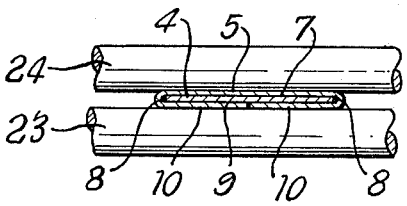
Figure 3:
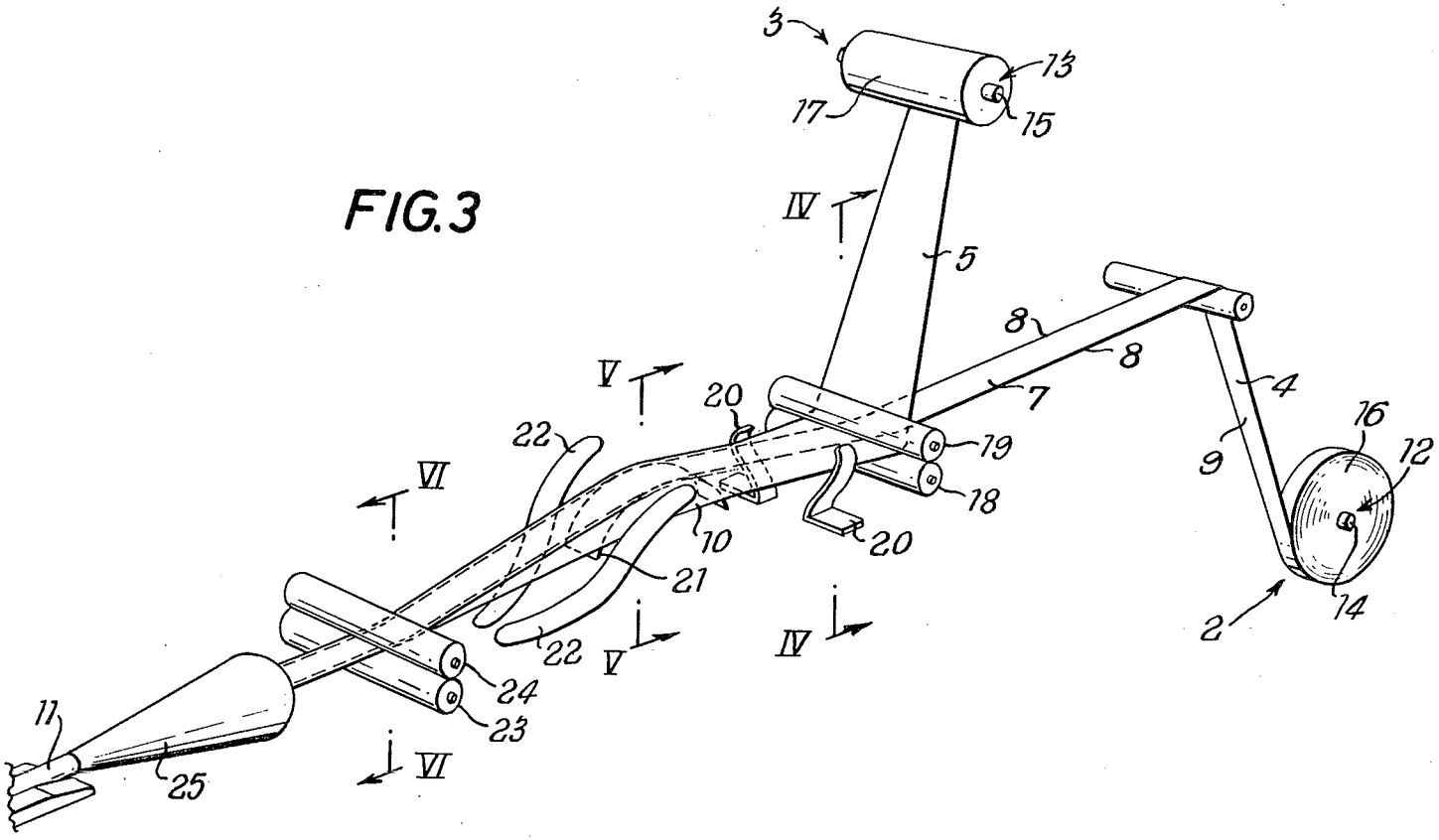

FIG. 2 a section on the line II—II in FIG. 1,

FIG. 3 a diagrammatic perspective view of apparatus for producing such a filter, and FIGS. 4, 5 and 6 are sections to a larger scale on the lines IV—IV, V—V, VI—VI respectively in FIG. 3.

The cigarette filter 1 shown in FIGS. 1 and 2 is composed of absorbent paper 2 and a fibrous filtering composition 3, in the example cellulose acetate tow, which is associated with the paper in superimposed layers and folded, or wound, substantially parallel to the longitudinal axis 6 of the filter 1. The paper 2 and cellulose acetate 3 are supplied in the form of strips 4 and 5 (FIG. 3) which, in the filter, extend in the direction of the axis 6. The cellulose acetate strip 5 has a greater width than the paper strip 4 and is so associated with the latter in the filter that, on the one hand, it covers one face 7 of the latter and, on the other hand, it is folded in along the two longitudinal edges 8 of the paper strip 4 so as to cover the other face 9 of the latter strip 4, which is thus completely enrobed or enclosed in cellulose acetate.

The process for the production of such filters consists, as illustrated by FIGS. 3 to 6, in joining together in the flat state, by pressure, the paper strip 4 and superimposed cellulose acetate strip 5, which has a width substantially equal to twice the width of the strip 4, the connection being made with the longitudinal central axes of the strips 4 and 5 substantially superimposed. The assembly of the two strips thus produced is then supported so that only the paper strip 4, situated under the cellulose acetate strip 5, rests on the supporting means and the strip 5 is so guided that marginal portions 10 are folded in along two edges 8 of the strip 4 and applied against the face 9 of the said strip, to which the two said portions 10 are connected by pressure. In a manner known per se, the resultant assembly is then folded to form a cylinder 11, which will be cut at right angles to its axis to provide the filters.

Apparatus for producing the filters 1 and for carrying out the above-described process comprises (FIG. 3)

two spools 12 and 13, with parallel axes 14 and 15, which support a reel 16 of paper strip and a reel 17 of cellulose-acetate strip respectively. Two pressure rollers 18 and 19 (FIGS. 3 and 4), disposed with their axes parallel to the axes of the spools 12 and 13, serve to join together, in a flat state, the paper strip 4 and cellulose-acetate strip 5. Guides 20 disposed downstream of the rollers 18 and 19 and on each side of the assembly of strips 4 and 5 are so profiled as to bear against the portions 10 of the strip 5 and fold them downwardly, along the edges 8 of the strip 4, so that they are at an angle of about 90° to the latter strip. A curved support 21 (FIGS. 3 and 5) is provided, downstream of the guides 20, under the assembly of strips 4 and 5, the width of this support being substantially equal to the width of the paper strip 4. Two guides 22 (FIGS. 3 and 5) extending downstream of the support 21 and one on each side of the assembly of strips 4 and 5 are so profiled as to fold in the marginal portions 10 of the strip 5 and to apply them against the face 9 of the strip 4. Pressure rollers 23 and 24 (FIGS. 3 and 6) disposed, parallel to the rollers 18 and 19, downstream of the guides 22 cause the marginal portions 10 of the cellulose acetate to adhere completely to the paper. Finally, the apparatus comprises a conical element 25, which forms the cylinder 11 in known manner by folding up the joined strips 4 and 5, and a known cutting element, not shown, which cuts the cylinder 11 at right angles to its axis at regular intervals to provide filters 1 or multiple filter lengths.

I claim:

1. A tobacco-smoke filter composed of absorbent paper and a filtering composition comprising a tow of material, selected from the group consisting of fibres and filaments, associated with the paper in superimposed layers, wherein the absorbent paper and filtering composition are in the form of strips extending longitudinally of the filter, the filtering-composition strip having a width greater than the width of the paper strip and being associated with the paper strip to cover one face of the latter and having folds along the two longitudinal edges of the paper strip to form marginal portions covering at least part of the other face thereof.

2. A filter according to claim 1, wherein the width of the filtering-composition strip is substantially equal to twice the width of the paper strip, so that the latter is completely enrobed by the filtering composition.

3. A filter according to claim 1, wherein the tow comprises a material selected from the group consisting of cellulose acetate, polypropylene and viscose.

* * * * *